US006740177B2

(12) United States Patent
Wood et al.

(10) Patent No.: US 6,740,177 B2
(45) Date of Patent: May 25, 2004

(54) NICKEL-BASE ALLOY

(75) Inventors: John Herbert Wood, St. Johnsonville, NY (US); Gangjigang Feng, Greenville, SC (US); Cyril Gerard Beck, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/064,607

(22) Filed: Jul. 30, 2002

(65) Prior Publication Data

US 2004/0022661 A1 Feb. 5, 2004

(51) Int. Cl.[7] ..... C22C 19/05

(52) U.S. Cl. ..... 148/428; 148/410; 420/447; 420/448; 420/449

(58) Field of Search ..... 420/447, 448, 420/449; 148/410, 428

(56) References Cited

U.S. PATENT DOCUMENTS 4,039,330 A * 8/1977 Shaw ..... 420/448
4,108,647 A * 8/1978 Shaw ..... 420/448
4,207,098 A * 6/1980 Shaw ..... 420/443
4,288,247 A * 9/1981 Shaw ..... 420/443
4,608,094 A * 8/1986 Miller et al. ..... 148/677
4,810,467 A 3/1989 Wood et al. ..... 420/448
6,106,767 A * 8/2000 Kennedy et al. ..... 420/448
6,258,317 B1 * 7/2001 Smith et al. ..... 420/448

FOREIGN PATENT DOCUMENTS

JP 61-73853 * 4/1986 ..... 420/448

* cited by examiner

*Primary Examiner*—John P Sheehan
(74) *Attorney, Agent, or Firm*—Ernest Cusick; Gary M. Hartman; Domenica N. S. Hartman

(57) ABSTRACT

A castable and weldable nickel-base alloy that exhibits a desirable balance of strength and resistance to corrosion and oxidation suitable for gas turbine engine applications. A suitable composition for the alloy consists essentially of, by weight, 10% to 25% cobalt, 20% to 28% chromium, 1% to 3% tungsten, 0.5% to 1.5% aluminum, 1.5% to 2.8% titanium, 0.8% to 1.45% columbium, tantalum in an amount less than columbium and Cb+0.508Ta is 1.15% to 1.45%, 0.001% to 0.025% boron, up to 0.4% zirconium, 0.02% to 0.15% carbon, with the balance essentially nickel and incidental impurities.

19 Claims, 3 Drawing Sheets

NICKEL-BASE ALLOY

BACKGROUND OF INVENTION

1. Field of the Invention

The present invention generally relates to nickel-base alloys. More particularly, this invention relates to castable and weldable nickel-base alloys exhibiting desirable properties suitable for gas turbine engine applications.

2. Description of the Related Art

The superalloy GTD-222 (U.S. Pat. No. 4,810,467) has a number of desirable properties for gas turbine engine applications, such as nozzles (vanes) in the latter (second and third) stages of the turbine section. The nominal composition of GTD-222 is, by weight, about 19% cobalt, about 22.5% chromium, about 2% tungsten, about 1.2% aluminum, about 2.3% titanium, Al+Ti of about 3.5%, about 0.8% columbium (niobium), about 1.0% tantalum, about 0.01% boron, about 0.01% zirconium, about 0.1% carbon, with the balance essentially nickel and incidental impurities. As with the formulation of other nickel-base alloys, the development of GTD-222 involved careful and controlled adjustments of the concentrations of certain critical alloying elements to achieve a desired mix of properties. For use in turbine nozzle applications, and particularly the latter stage nozzle for which GTD-222 is used, such properties include high temperature strength, castability, weldability, and resistant to low cycle fatigue, corrosion and oxidation. The thermal environment within the second stage of a turbine section is sufficiently severe to require an oxidation-resistant coating, a thermal barrier coating (TBC), and/or internal cooling for nozzles formed of the GTD-222 alloy. The properties of GTD-222 are sufficient to allow third stage nozzles to achieve the design life required of the nozzles without such additional measures When attempting to optimize any one of the desired properties of a superalloy, other properties are often adversely affected. A particular example is weldability and creep resistance, both of which are of great importance for gas turbine engine nozzles. However, greater creep resistance results in an alloy that is more difficult to weld, which is necessary to allow for repairs by welding. A desirable combination of creep strength and weldability exhibited by GTD-222 is believed to be the result of the use of judicious levels of aluminum, titanium, tantalum and columbium in the alloy. Each of these elements participates in the gamma prime (γ') precipitation-strengthening phase ($Ni^3(Ti,Al)$). Aluminum and titanium are the key elements in the formation of the gamma-prime phase, while the primary role of tantalum and columbium is to participate in the MC carbide phase. Tantalum and columbium remaining after MC carbide formation plays a lesser but not insignificant role in the formation of the gamma-prime phase.

While GTD-222 has been proven to perform well as the alloy for latter stage nozzles of gas turbine engines, alternatives would be desirable. Of current interest is the reduction in tantalum used in view of its high cost. However, the properties of an alloy with a reduced tantalum content would preferably be closely matched with those of GTD-222, particularly for use as the alloy for second and third stage nozzles.

SUMMARY OF INVENTION

The present invention provides a nickel-base alloy that exhibits a desirable balance of strength (including creep resistance) and resistance to corrosion and oxidation suitable for nozzles of the latter stages of a gas turbine engine, particularly the second and third stage nozzles. The alloy is also castable, relatively easier to weld than GTD-222, and has acceptable heat treatment requirements. These desirable properties are achieved with an alloy in which tantalum is eliminated or at a relatively low level, and a relatively high level of columbium is maintained to achieve properties similar to that of the GTD-222 alloy.

According to the invention, the nickel-base alloy consists essentially of, by weight, 10% to 25% cobalt, 20% to 28% chromium, 1% to 3% tungsten, 0.5% to 1.5% aluminum, 1.5% to 2.8% titanium, 0.8% to 1.45% columbium, tantalum in an amount less than columbium and Cb+0.508Ta is 1.15% to 1.45%, 0.001% to 0.025% boron, up to 0.05% zirconium, 0.02% to 0.15% carbon, with the balance essentially nickel and incidental impurities. The columbium content of the alloy is preferably at least 0.9%, more preferably at least 1.25%, while the tantalum content of the alloy is preferably less than 0.5%, more preferably entirely omitted from the alloy.

The alloy of this invention has properties comparable to those of the GTD-222 alloy, with potentially improved ductility and weldability and with no degradation in castability. Notably, improved weldability of the alloy is achieved without sacrificing creep resistance. These properties and advantages are achieved even though the relative amounts of tantalum and columbium are opposite those of GTD-222, namely, more columbium is present in the alloy than tantalum, with a preferred maximum level of tantalum being below the minimum amount of tantalum required for GTD-222. The desired properties are believed to be achieved by maintaining a substantially constant combined atomic percent of columbium and tantalum in the alloy, in which columbium contributes greater to the combined amount than does tantalum as a result of specifying the combined amount according to the formula Cb+0.508Ta. Contrary to GTD-222 (U.S. Pat. No. 4,810,467), second and third stage nozzles exhibit excellent properties when cast from the alloy in which tantalum is essentially absent, i.e., only impurity levels are present. Consequently, the alloy of this invention provides an excellent and potentially lower-cost alternative to GTD-222 as a result of reducing or eliminating the requirement for tantalum.

Other objects and advantages of this invention will be better appreciated from the following detailed description.

DETAILED DESCRIPTION

Figure 1:
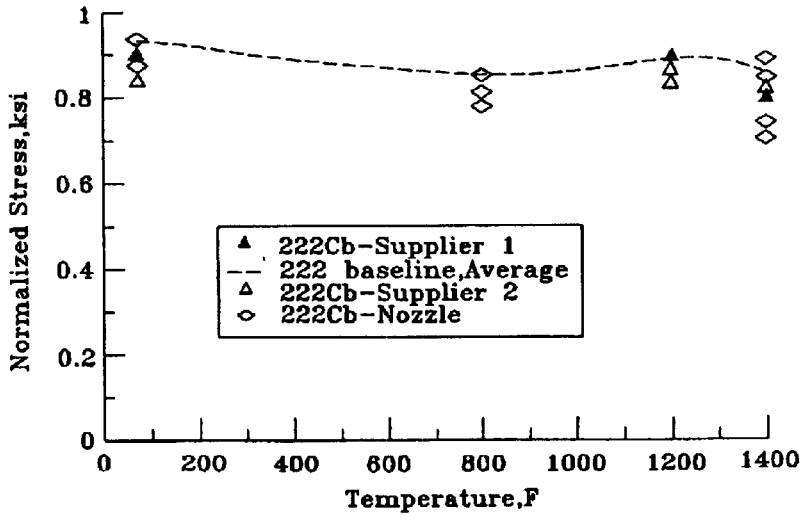
FIGS. 1 through 3 are graphs plotting tensile strength, yield strength and percent elongation versus temperature for the GTD-222 nickel-base alloy and nickel-base alloys within the scope of the present invention.

The present invention was the result of an effort to develop a nickel-base alloy having properties comparable to the nickel-base alloy commercially known as GTD-222 and disclosed in U.S. Pat. No. 4,810,467, incorporated herein by reference, but whose chemistry is carefully balanced to allow for the reduction or complete elimination of tantalum. The investigation resulted in the development of a nickel-base alloy whose properties are particularly desirable for nozzles used in the second or third turbine stages of a gas turbine engine. Therefore, particular properties of interest include creep strength, weldability, fatigue life, castability, metallurgical stability and oxidation resistance. The approach of the investigation resulted in the increase in columbium to substitute for the absence of tantalum, and as a result radically altered two of the minor alloying elements of GTD-222 that are known to effect the gamma-prime precipitation hardening phase.

The high-temperature strength of a nickel-base superalloy is directly related to the volume fraction of the gamma-prime phase, which in turn is directly related to the total amount of the gamma prime-forming elements (aluminum, titanium, tantalum and columbium) present. Based on these relationships, the amounts of these elements required to achieve a given strength level can be estimated. The compositions of the gamma-prime phase and other secondary phases such as carbides and borides, as well as the volume fraction of the gamma-prime phase, can also be estimated based on the starting chemistry of the alloy and some basic assumptions about the phases which form. By such a procedure, it was concluded that an alloy having the desired level of creep strength for second and third stage nozzles should contain about 18 volume percent or more of the gamma-prime phase. However, other properties important to gas turbine engine nozzles, such as weldability, fatigue life, castability, metallurgical stability and oxidation resistance, cannot be predicted from amounts of these and other elements.

Two alloys having the approximate chemistries set forth in Table I below were formulated and cast during the investigation. Castings of the GTD-222 alloy were also prepared having the following approximate chemistry, by weight: 19% cobalt, about 22.5% chromium, about 2% tungsten, about 1.2% aluminum, about 2.3% titanium, about 0.8% columbium, about 1% tantalum, about 0.008% boron, about 0.022% zirconium, about 0.1% carbon, with the balance essentially nickel and incidental impurities. Castings of each alloy underwent a heat treatment cycle that entailed a solution treatment at about 2100° F. (about 1150° C.) for about two hours, followed by aging at about 1475° F. (about 800° C.) for about eight hours. The specimens were then machined from the castings in a conventional manner.

TABLE I

| | Alloy No. B1 | Alloy No. B2 |
|---|---|---|
| Co | 19.06 | 19.10 |
| Cr | 2.86 | 22.40 |
| W | 1.96 | 2.02 |
| Al | 1.17 | 1.21 |
| Ti | 2.29 | 2.32 |
| Cb | 1.28 | 1.32 |
| Ta | 0.01 | 0.09 |
| B | 0.003 | 0.003 |
| Zr | 0.007 | 0.007 |
| C | 0.09 | 0.10 |
| Mo | <0.01 | 0.03 |
| Hf | <0.01 | 0.00 |
| Ni | Balance | Balance |

Figure 2:
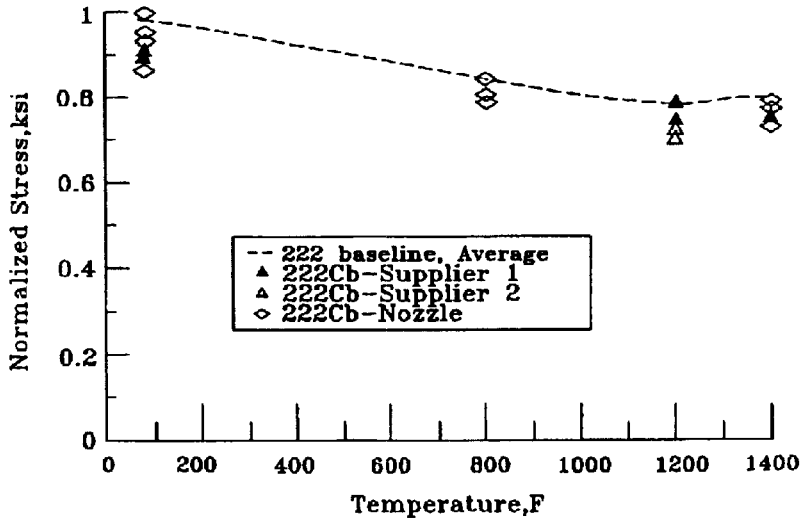
Figure 3:
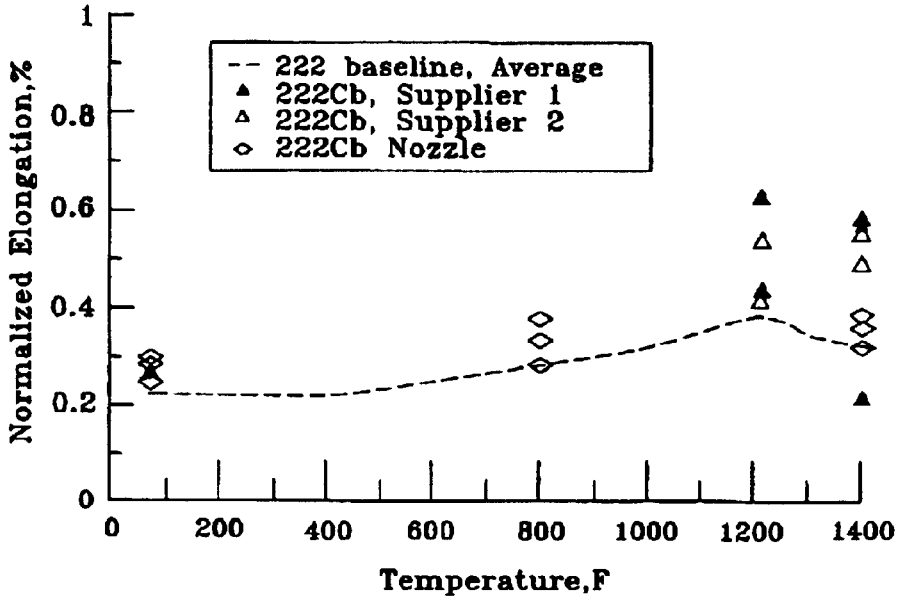

The above alloying levels were selected to evaluate the effect of substituting columbium for tantalum, but otherwise were intended to retain the GTD-222 composition. Tensile properties of the alloys were determined with standard smooth bar specimens. The normalized data are summarized in FIGS. 1, 2 and 3, in which "222 baseline, Average" plots the historical average of GTD-222 for the particular property, "222Cb-Supplier 1" designates data for the B1 specimens, and "222Cb-Supplier 2" designates data for the B2 specimens. Also evaluated was a gas turbine engine nozzle cast from the same alloy as the B1 specimens. The data indicate that the tensile strength of the B1 and B2 specimens was about three to about five percent lower than the GTD-222 baseline, but ductility was much higher in the B1 and B2 specimens—on the order of about 30% to 40% higher. The high ductility and similar tensile strength of the B1 and B2 alloys compared with GTD-222 indicated that the experimental alloys might be suitable alternatives to GTD-222.

Figure 4:
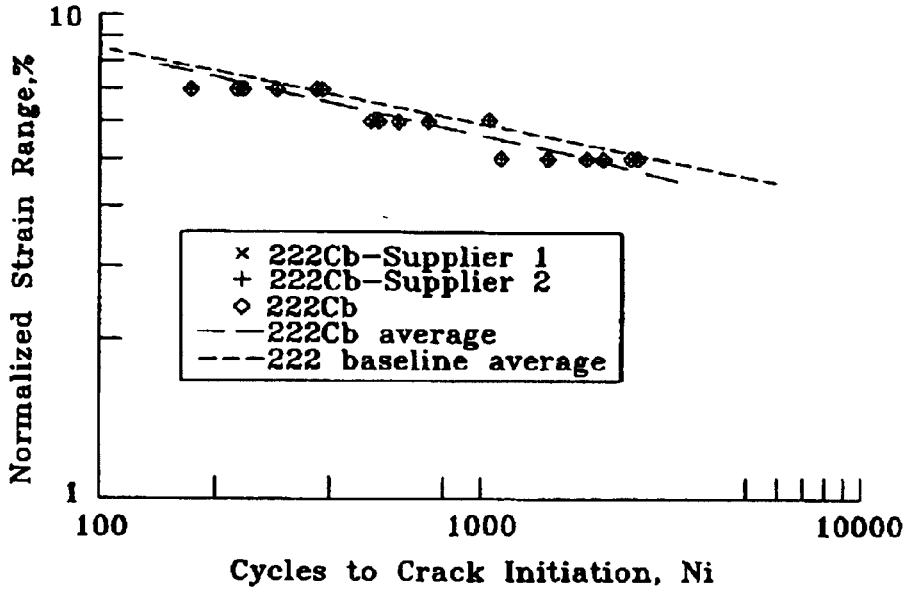
FIGS. 4 and 5 are graphs plotting low cycle fatigue life at 1400° F. and 1600° F. respectively, for the GTD-222 alloy and alloys within the scope of the present invention.
Figure 5:
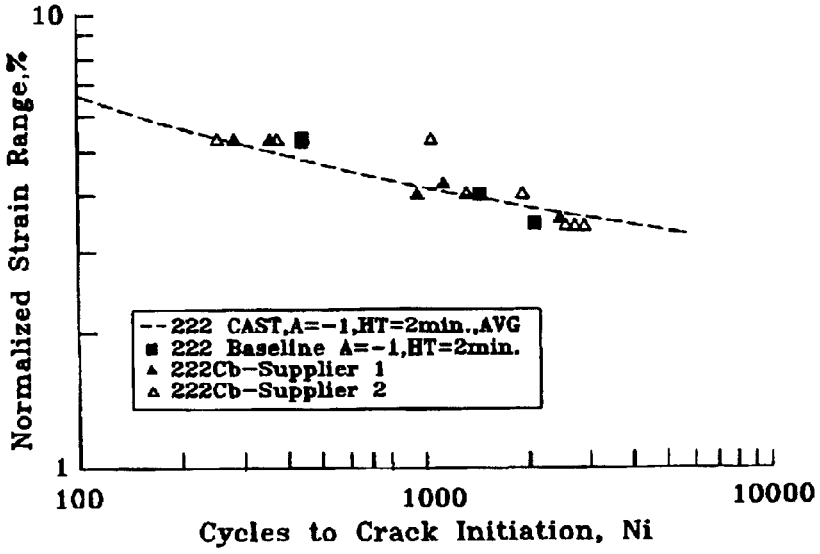

FIGS. 4 and 5 are graphs plotting low cycle fatigue (LCF) life at 1400° F. (about 760° C.) and 1600° F. (about 870° C.), respectively, for the B1 and B2 alloys and GTD-222. In both tests, 0.25 inch (about 8.2 mm) bars were cycled to crack initiation. In FIG. 4, 3 σ("3S") is also plotted for the evaluated alloys (averaged) as well as GTD-222. The 3 σ plot indicates that the LCF life of the B1 and B2 alloys at 1400° F. was essentially the same as the GTD-222 baseline at strain levels above about 0.5%, but was lower by about 15% to 25% at strains less than 0.5%. In FIG. 5, the data for the 1600° F. LCF test evidence that the B1 and B2 alloys exhibited essentially the same LCF life as GTD-222.

Figure 6:
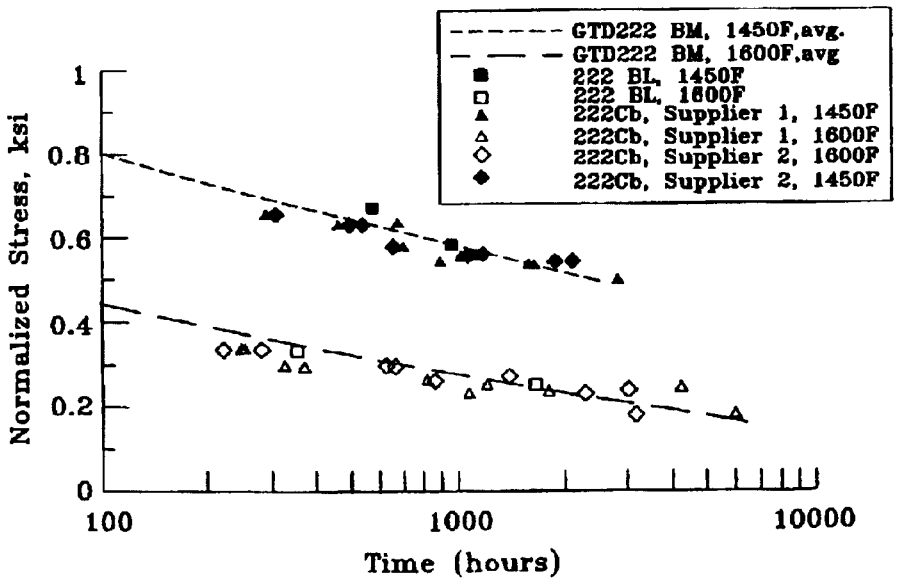
FIG. 6 is a graph plotting creep life at 1450° F. and 1600° F. for the GTD-222 alloy and alloys within the scope of the present invention.

FIG. 6 is a graph plotting creep life for the B1 and B2 alloys and GTD-222 at a strain level of about 0.5% and temperatures of about 1450° F. (about 790° C.) and 1600° F. (about 870° C.). At the 1450° F. test temperature, the B1 and B2 alloys exhibited a creep life that was essentially the same as GTD-222. At the 1600° F. test temperature, the short-term life of the B1 and B2 alloys was lower than GTD-222 as predicted by the tensile data. However, FIG. 6 evidences that the long-term creep life of the B1 and B2 alloys is essentially the same as GTD-222.

Additional tests were performed on the B1 and B2 alloys to compare various other properties to GTD-222. Such tests included high cycle fatigue (HCF) and low cycle fatigue (LCF) testing, oxidation resistance, weldability, castability, diffusion coating characteristics, and physical properties. In all of these investigations, the properties of the B1 and B2 alloys were essentially identical to that of the GTD-222 baseline, with the exception of weldability in which the B1 and B2 alloys were surprisingly found to exhibit slightly better weldability than GTD-222 in terms of resistance to cracking.

Furthermore, the LCF life of TIG welded joints in the B1 and B2 alloys was determined to be about two times longer than that of TIG welded joints formed in GTD-222, which was consistent with the results of the weldability study.

On the basis of the above, an alloy having the broad, preferred and nominal compositions (by weight) and gamma prime content (by volume) summarized in Table II is believed to have properties comparable to GTD-222 and therefore suitable for use as the alloy for the latter stage nozzles of a gas turbine engine, as well as other applications in which similar properties are required.

TABLE II

| | Broad | Preferred | Nominal |
|---|---|---|---|
| Co | 10 to 25 | 18.5 to 19.5 | 19 |
| Cr | 20 to 28 | 22.2 to 22.8 | 22.5 |
| W | 1 to 3 | 1.8 to 2.2 | 2 |

TABLE II-continued

| | Broad | Preferred | Nominal |
|---|---|---|---|
| Al | 0.5 to 1.5 | 1.1 to 1.3 | 1.2 |
| Ti | 1.5 to 2.8 | 2.2 to 2.4 | 2.3 |
| Cb | 0.8 to 1.45 | 1.25 to 1.45 | 1.3 |
| Ta | Less than Cb | Less than 0.5 | 0.0 |
| Cb + 0.508 Ta | 1.15 to 1.45 | 1.25 to 1.45 | 1.3 |
| B | 0.001 to 0.025 | 0.002 to 0.015 | 0.01 |
| Zr | up to 0.4 | 0.005 to 0.02 | 0.01 |
| C | 0.02 to 0.15 | 0.08 to 0.12 | 0.1 |
| Ni | Balance | Balance | Balance |
| Y' | 25 to 38 vol. % | 33 to 38 vol. % | |

The formula Cb+0.508Ta was derived to maintain a constant atomic percent of combined tantalum and columbium in the alloy, though with a clear preference for columbium. Tantalum is preferably kept below levels allowed in GTD-222, and more preferably is entirely omitted from the alloy in view of the investigation reported above. The ranges established for columbium are believed to be necessary to compensate for the absence or reduced level of tantalum in order to maintain the properties desired for the alloy and exhibited by alloys B1 and B2 during the investigation. It is believed that the alloy identified above in Table II can be satisfactorily heat treated using the treatment described above, though conventional heat treatments adapted for nickel-base alloys could also be used.

While the invention has been described in terms of a preferred embodiment, it is apparent that other forms could be adopted by one skilled in the art. Therefore, the scope of the invention is to be limited only by the following claims.

What is claimed is:

1. A castable weldable nickel-base alloy consisting of, by weight, 10% to 25% cobalt, 20% to 28% chromium, 1% to 3% tungsten, 0.5% to 1.5% aluminum, 1.5% to 2.8% titanium, 0.8% to 1.45% columbium, tantalum in an amount less than 0.1% and Cb+0.508Ta is 1.15% to 1.45%, 0.001% to 0.025% boron, up to 0.4% zirconium, 0.02% to 0.15% carbon, with the balance essentially nickel and incidental impurities.

2. The alloy according to claim 1, wherein the columbium content is at least 1.25%.

3. The alloy according to claim 1, wherein the tantalum content is 0.01% to 0.09%.

4. The alloy according to claim 1, wherein the alloy is essentially free of tantalum.

5. The alloy according to claim 1, wherein the cobalt content is 18.5% to 19.5%, the chromium content is 22.2% to 22.8%, the tungsten content is 1.8% to 2.2%, the aluminum content is 1.1% to 1.3%, the titanium content is 2.2% to 2.4%, the boron content is 0.002% to 0.015%, the zirconium content is 0.005% to 0.4%, and the carbon content is 0.08% to 0.12%.

6. The alloy according to claim 1, wherein the alloy contains at least 18 volume percent of a gamma-prime precipitate phase.

7. The alloy according to claim 1, wherein the alloy is in the form of a cast nozzle of a gas turbine engine.

8. The alloy according to claim 7, wherein the nozzle is installed in a second or third turbine stage of the gas turbine engine.

9. A castable weldable nickel-base alloy consisting of, by weight, 18.5% to 19.5% cobalt, 22.2% to 22.8% chromium, 1.8% to 2.2% tungsten, 1.1% to 1.3% aluminum, 2.2% to 2.4% titanium, 0.9% to 1.45% columbium, less than 0.1% tantalum and Cb+0.508Ta is 1.15% to 1.45%, 0.002% to 0.015% boron, 0.005% to 0.4% zirconium, 0.08% to 0.12% carbon, with the balance essentially nickel and incidental impurities.

10. The alloy according to claim 9, wherein the tantalum content in 0.01% to 0.09%.

11. The alloy according to claim 9, wherein the alloy is essentially free of tantalum.

12. The alloy according to claim 9, wherein the columbium content is about 1.3%.

13. The alloy according to claim 9, wherein the alloy contains about 25 to about 38 volume percent of a gamma-prime precipitate phase.

14. The alloy according to claim 9, wherein the alloy is in the form of a cast nozzle of a gas turbine engine.

15. The alloy according to claim 14, wherein the nozzle is installed in a second or third turbine stage of the gas turbine engine.

16. A castable weldable nickel-base alloy consisting of, by weight, about 19% cobalt, about 22.5% chromium, about 2% tungsten, about 1.2% aluminum, about 2.3% titanium, about 1.3% columbium, about 0.01% boron, about 0.01% zirconium, about 0.1% carbon, with the balance essentially nickel and incidental impurities.

17. The alloy according to claim 16, wherein the alloy contains about 33 to about 38 volume percent of a gamma-prime precipitate phase.

18. The alloy according to claim 16, wherein the alloy is in the form of a cast nozzle of a gas turbine engine.

19. The alloy according to claim 18, wherein the nozzle is installed in a second or third turbine stage of the gas turbine engine.

* * * * *

UNITED STATES PATENT AND TRADEMARK OFFICE

CERTIFICATE OF CORRECTION

PATENT NO. : 6,740,177 B2
DATED : May 25, 2004
INVENTOR(S) : John Herbert Wood et al.

It is certified that error appears in the above-identified patent and that said Letters Patent is hereby corrected as shown below:

Title page,
Item [75], Inventors, "St. Johnsonville, NY" should be -- St. Johnsville, NY -- and "Gangjiang Feng" should be -- Ganjiang Feng --

Signed and Sealed this

Sixteenth Day of November, 2004

JON W. DUDAS
*Director of the United States Patent and Trademark Office*